US011197515B2

(12) United States Patent
Armon et al.

(10) Patent No.: US 11,197,515 B2
(45) Date of Patent: Dec. 14, 2021

(54) SOLE BOARD

(71) Applicant: adidas AG, Herzogenaurach (DE)

(72) Inventors: Aric Armon, Portland, OR (US); Jeremy Determan, Beaverton, OR (US); Frances Huang, Portland, OR (US); Derek Luther, Portland, OR (US); Nick Martushev, Portland, OR (US); Kevin Murphy, Portland, OR (US)

(73) Assignee: adidas AG, Herzogenaurach (DE)

( * ) Notice: Subject to any disclaimer, the term of this patent is extended or adjusted under 35 U.S.C. 154(b) by 41 days.

(21) Appl. No.: 16/252,056

(22) Filed: Jan. 18, 2019

(65) Prior Publication Data

US 2019/0150567 A1 May 23, 2019

Related U.S. Application Data

(63) Continuation of application No. 15/423,221, filed on Feb. 2, 2017, now Pat. No. 10,231,514.

(51) Int. Cl.

| | |
|---|---|
| ***A43B 17/02*** | (2006.01) |
| ***A43C 15/16*** | (2006.01) |
| ***A43B 13/12*** | (2006.01) |
| ***A43B 17/14*** | (2006.01) |
| ***A43B 13/18*** | (2006.01) |
| ***A43B 17/00*** | (2006.01) |
| ***A43B 13/14*** | (2006.01) |

(52) U.S. Cl.

CPC ..... *A43B 17/02* (2013.01); *A43B 13/12* (2013.01); *A43B 13/141* (2013.01); *A43B 13/188* (2013.01); *A43B 17/003* (2013.01); *A43B 17/14* (2013.01); *A43C 15/16* (2013.01)

(58) Field of Classification Search

CPC ..... A43B 17/00; A43B 17/02; A43B 17/003; A43B 17/14; A43B 13/12; A43B 13/141; A43B 13/188; A43C 15/16

See application file for complete search history.

(56) References Cited

U.S. PATENT DOCUMENTS

| | | | |
|---|---|---|---|
| 511,942 | A | 1/1894 | Glanville |
| 2,041,901 | A | 5/1936 | Cavanagh |
| 2,065,405 | A | 12/1936 | Sewall |
| 2,181,787 | A | 11/1939 | Lumbard |
| 2,211,057 | A | 8/1940 | Duckoff |
| 2,318,926 | A | 5/1943 | Daniels |

(Continued)

FOREIGN PATENT DOCUMENTS

| | | | |
|---|---|---|---|
| CN | 1149444 | A | 5/1997 |
| CN | 204207162 | U | 3/2015 |

(Continued)

*Primary Examiner* — Ted Kavanaugh

(74) *Attorney, Agent, or Firm* — Sterne, Kessler, Goldstein & Fox P.L.L.C.

(57) ABSTRACT

A sole board for an article of footwear includes a plate that has a forefoot region, a midfoot region, and a heel region. The sole board includes a channel disposed in a top surface of the plate in the forefoot region. The channel extends from a lateral edge of the plate to a medial edge of the plate. A characteristic of the channel at the lateral and medial edges of the plate is different than the characteristic of the channel at a middle of the channel.

20 Claims, 20 Drawing Sheets

(56) References Cited

U.S. PATENT DOCUMENTS

| | | | | |
|---|---|---|---|---|
| 4,667,423 | A * | 5/1987 | Autry | A43B 13/12 36/102 |
| 4,925,724 | A | 5/1990 | Ogden | |
| 5,720,118 | A | 2/1998 | Mayer et al. | |
| 7,100,307 | B2 | 9/2006 | Burke et al. | |
| D561,443 | S * | 2/2008 | Robinson, Jr. | D2/953 |
| D587,442 | S * | 3/2009 | Robinson, Jr. | D2/953 |
| 8,919,015 | B2 * | 12/2014 | Holt | A43B 13/181 36/102 |
| 10,231,514 | B2 * | 3/2019 | Armon | A43B 13/141 |
| 2002/0050075 | A1 | 5/2002 | Moretti | |
| 2002/0121031 | A1 * | 9/2002 | Smith | A43B 7/1415 36/29 |
| 2003/0131501 | A1 * | 7/2003 | Erickson | A43B 3/0078 36/127 |
| 2006/0064905 | A1 * | 3/2006 | Hudson | A43B 1/0072 36/128 |
| 2006/0130361 | A1 | 6/2006 | Robinson, Jr. et al. | |
| 2014/0013624 | A1 * | 1/2014 | Stockbridge | A43B 13/181 36/103 |
| 2014/0059889 | A1 * | 3/2014 | Lukongwa | A43B 3/26 36/97 |
| 2014/0250723 | A1 * | 9/2014 | Kohatsu | A43B 3/26 36/88 |
| 2017/0079376 | A1 | 3/2017 | Bunnell et al. | |
| 2017/0127755 | A1 | 5/2017 | Bunnell et al. | |

FOREIGN PATENT DOCUMENTS

| | | | |
|---|---|---|---|
| EP | 0 958 752 | A1 | 11/1999 |
| EP | 3 097 810 | A1 | 11/2016 |
| WO | WO 01/06885 | A1 | 2/2001 |

* cited by examiner

SOLE BOARD

CROSS-REFERENCE TO RELATED APPLICATION

This application is a continuation of U.S. patent application Ser. No. 15/423,221, filed Feb. 2, 2017, titled "Sole Board," the disclosure of which is incorporated herein in its entirety by reference thereto.

BACKGROUND

Field

Embodiments of the present invention relate generally to a sole board for an article of footwear; and more specifically to a sole board with a channel.

Background

Individuals can be concerned with the amount of cushioning, support, or flexibility an article of footwear provides. This is true for articles of footwear worn for non-performance activities, such as a leisurely stroll, and for performance activities, such as running, because throughout the course of an average day, the feet and legs of an individual are subjected to substantial impact forces. When an article of footwear contacts a surface, considerable forces may act on the article of footwear and, correspondingly, the wearer's foot.

The human foot is a complex and remarkable piece of machinery, capable of withstanding and dissipating many impact forces. The natural padding of fat at the heel and forefoot, as well as the flexibility of the arch, help to cushion the foot. Although the human foot possesses natural cushioning and rebounding characteristics, the foot alone is incapable of effectively overcoming many of the forces encountered during every day activity. Unless an individual is wearing footwear that provides proper cushioning, support, and flexibility, the soreness and fatigue associated with every day activity is more acute, and its onset accelerated. The discomfort for the wearer that results may diminish the incentive for further activity. Also, inadequate cushioning, support, or flexibility in an article of footwear can lead to injuries such as blisters; muscle, tendon, and ligament damage; and bone stress fractures. Improper footwear can also lead to other ailments, including back pain.

BRIEF SUMMARY

Sole boards for articles of footwear are disclosed. In some embodiments, a sole board for an article of footwear includes a plate that has a forefoot region, a midfoot region, and a heel region. In some embodiments, the sole board includes a channel disposed in a top surface of the plate in the forefoot region. In some embodiments, the channel extends from a lateral edge of the plate to a medial edge of the plate. In some embodiments, a characteristic of the channel at the lateral and medial edges of the plate is different than the characteristic of the channel at a middle of the channel.

In some embodiments, the characteristic is a depth of the channel. In some embodiments, the characteristic is a width of the channel. In some embodiments, the width of the channel at the lateral and medial edges of the plate is greater than the width of the channel at the middle of the channel. In some embodiments, the width of the channel at the lateral and medial edges of the plate is at least twice the width of the channel at the middle of the channel. In some embodiments, the width of the channel at the lateral edge of the plate is equal to the width of the channel at the medial edge of the plate. In some embodiments, the width of the channel at the middle of the channel is 1.2 millimeters. In some embodiments, the width of the channel at the medial and lateral edges of the plate is 2.5 millimeters. In some embodiments, the channel extends along a metatarsal region in the forefoot region.

In some embodiments, the sole board also includes a lasting hole disposed in the midfoot region of the plate. In some embodiments, the sole board also includes a plurality of indents disposed in the top surface of the plate. In some embodiments, the plurality of indents forms a honeycomb pattern.

In some embodiments, a thickness of the plate tapers in the forefoot region. In some embodiments, a maximum thickness of the plate is five millimeters. In some embodiments, a minimum thickness of the plate is 1.5 millimeters.

In some embodiments, the plate includes a non-woven fabric. In some embodiments, the plate includes a plastic. In some embodiments, the plate includes polypropylene. In some embodiments, the plate includes a layer of a non-woven fabric and a layer of polypropylene. In some embodiments, the plate includes a layer of polypropylene disposed between two layers of a non-woven fabric.

In some embodiments, the sole board is an insole. In some embodiments, the sole board is a sock-liner. In some embodiments, the sole board is a cleat frame structure. In some embodiments, the cleat frame structure has cleats that extend from a bottom of the plate. In some embodiments, the sole board also includes a second plate disposed below the plate. In some embodiments, the sole board also includes a second channel disposed in a top surface of the second plate in the forefoot region underneath the channel in the plate.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
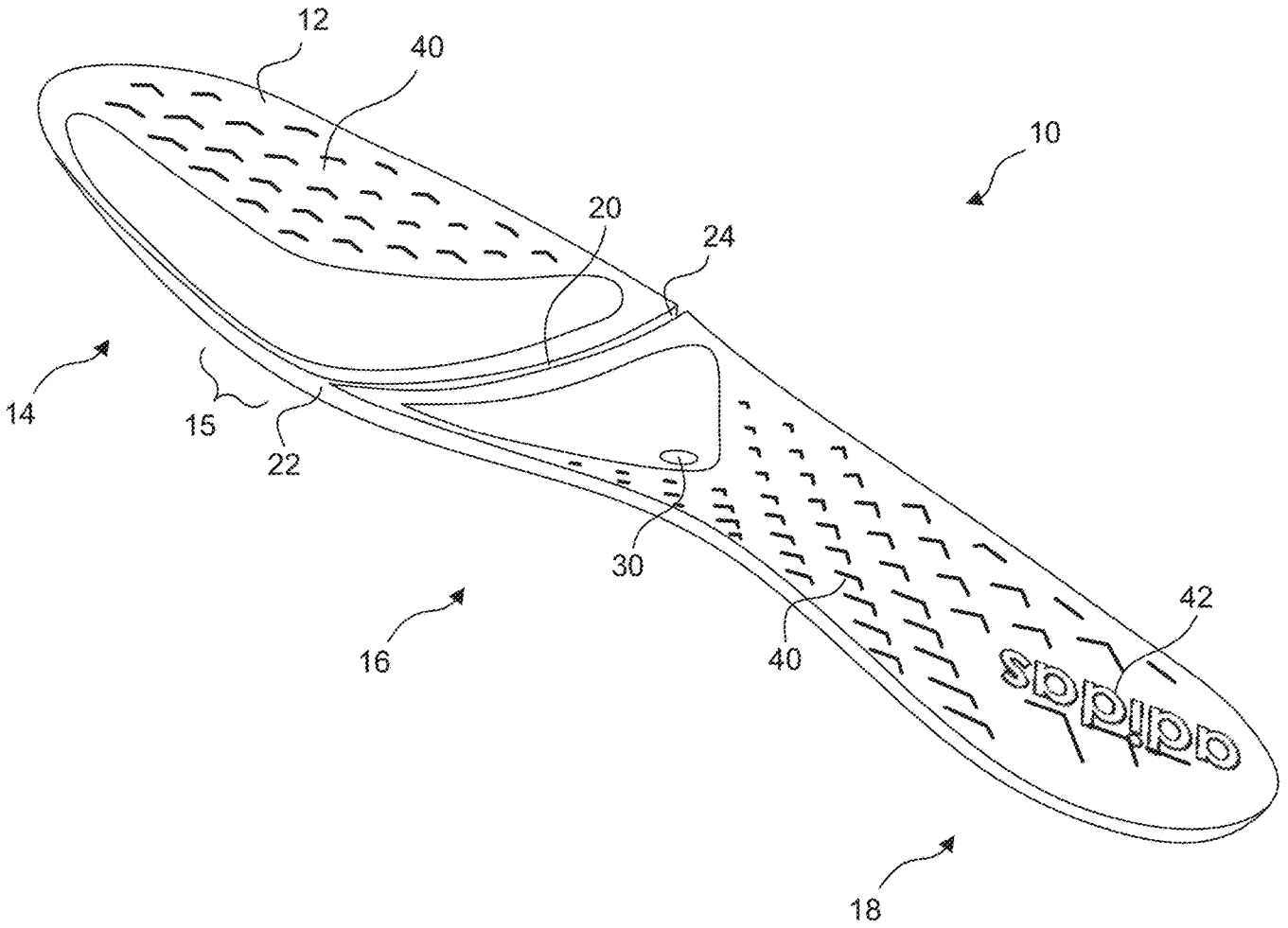
FIG. 1 shows a perspective view of a sole board according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide a sole board for articles of footwear. In some embodiments, a sole board may provide desired flexibility and stiffness for an article of footwear. In some embodiments, the sole board may be designed for a particular activity or a specific movement within that activity. For example, in some embodiments, the sole board may be used in articles of footwear used for various athletic activities or sports, such as football, soccer, baseball, basketball, running, walking, etc. Because specific movements in these or other sports may require a high amount of flexion, the article of footwear should be flexible enough to accommodate this flexion. At the same time, the article of footwear should also provide appropriate stiffness to protect a wearer's foot, for example, from injuries, such as hyperextension of the toes (i.e., turf toe). In addition, while a wearer is not engaged in specific movements that require a high amount of flexion, such as when the wearer is simply walking or running, the article of footwear should be more flexible and less stiff.

In some embodiments, the sole board comprises a plate configured to be disposed within an article of footwear as an insole or sock-liner. The sole board may be disposed between the midsole of the article of footwear and the wearer's foot. In some embodiments, the sole board may be removably inserted in the article of footwear. In some embodiments, the sole board may be fixedly attached to the article of footwear. In some embodiments, the sole board may have an upper surface contoured to receive the wearer's foot, thus forming a contoured footbed. In some embodiments, the sole board comprises a plate configured to be disposed on a bottom portion of the article of footwear, for example, as a cleat frame structure.

In some embodiments, the sole board (e.g., sock-liner, insole, or cleat frame structure) may include a channel in the top surface of the plate. In some embodiments, the channel may be disposed in a forefoot region of the sole board. For example, the channel may be disposed in a metatarsal region of the sole board (i.e., the region of the sole board that lies directly underneath the metatarsal bones of the wearer's foot when the article of footwear is worn). In some embodiments, the channel extends from a medial edge of the plate to a lateral edge of the plate. In some embodiments, the channel has a characteristic, such as a width or a depth, that is different at the medial edge and the lateral edge of the plate than in a middle of the plate. For example, the width of the channel at the medial edge and the lateral edge of the plate may be greater than the width of the channel at the middle of the plate. In some embodiments, the height or thickness of the sole board tapers towards the front of the plate.

A sole board 10, as shown, for example, in FIGS. 1-12, comprises a plate 12. While these figures show sole board 10 as a sole board for the right foot, it is to be understood that the sole board for the left foot would have similar features and may be a mirror image of the sole board depicted. In some embodiments, plate 12 comprises a forefoot region 14, a midfoot region 16, and a heel region 18. In some embodiments, plate 12 comprises a medial edge 22 and a lateral edge 24. In some embodiments, sole board 10 comprises an insole.

In some embodiments, plate 12 comprises a plastic. For example, plate 12 may comprise polypropylene. In some embodiments, plate 12 comprises a non-woven fabric. In some embodiments, plate 12 is made of multiple materials. In some embodiments, plate 12 comprises layers of different material. In some embodiments, plate 12 comprises a layer of non-woven fabric and a layer of polypropylene. In some embodiments, plate 12 comprises a layer of polypropylene disposed between two layers of non-woven fabric. In some embodiments, plate 12 comprises metal composites. For example, plate 12 may comprise steel composites. In some embodiments, plate 12 comprises a foam. For example, plate 12 may be made of polyurethane foam, ethyl vinyl acetate, or other foam composites. In some embodiments, plate 12 comprises thermoplastic polyurethane. In some embodiments, plate 12 comprises a nylon-based composite or other composite.

In some embodiments, plate 12 has a height or thickness that varies. In some embodiments, plate 12 has a maximum thickness of 5 millimeters. In some embodiments, plate 12 has a minimum thickness of 1.5 millimeters. In some embodiments, the thickness of plate 12 tapers in forefoot region 14, as shown, for example, in FIGS. 4-6. In some embodiments, the minimum thickness of plate 12 is disposed at the front of forefoot region 14 (i.e., at the toe). In some embodiments, the tapering in forefoot region 14 contributes to increased flexibility at lower amounts of bend of sole board 10 and increased stiffness at higher amounts of bend of sole board 10 (e.g., above 55 degrees of bending).

In some embodiments, sole board 10 comprises a channel 20, which may also be referred to as a groove. In some embodiments, channel 20 is disposed on a top surface of plate 12. In some embodiments, channel 20 is disposed in forefoot region 14. In some embodiments, channel 20 is disposed within forefoot region 14 at the region of plate 12 that lies directly underneath the metatarsal bones of the wearer's foot with the article of footwear is worn (i.e., metatarsal region 15), as shown, for example in FIGS. 1 and 2. Thus, channel 20 may extend laterally along metatarsal region 15 in forefoot region 14 from medial edge 22 to lateral edge 24. In some embodiments, channel 20 allows for greater flexibility of sole board 10 during initial bending (e.g., up until the sides of channel 20 come in contact with each other), and provides less flexibility and greater stiffness of sole board 10 during later bending (e.g., after the sides of channel 20 come in contact with each other), as will be described more fully below.

In some embodiments, channel 20 may have a V-shaped cross section. In some embodiments, channel 20 may be curved (i.e. nonlinear). In some embodiments, channel 20 may be linear. In some embodiments, from a z-axis perspective (e.g., from a rear cross-sectional view), the end portions of channel 20 (i.e., at medial edge and/or lateral edge 24) may be higher than a middle portion of channel 20 given the contour of the footbed. Thus, in some embodiments, channel 20 may appear linear from one perspective (e.g., a top planar view, as in FIG. 2) but be curved to follow the contour of the footbed.

In some embodiments, as shown, for example, in FIGS. 3-12, plate 12 comprises a projection 44 that extends from a bottom surface of plate 12. In some embodiments, projection 44 is spaced from the outer edges of plate 12, such as medial edge 22 and lateral edge 24. In some embodiments, projection 44 provides additional cushioning for the wearer's foot. In some embodiments, projection 44 varies in width along the length of plate 12. For example, projection 44 may be wider in forefoot region 14 (see FIGS. 7 and 8) than in midfoot region 16 (see FIGS. 9 and 10) and heel region 18 (see FIGS. 11 and 12).

Figure 2:
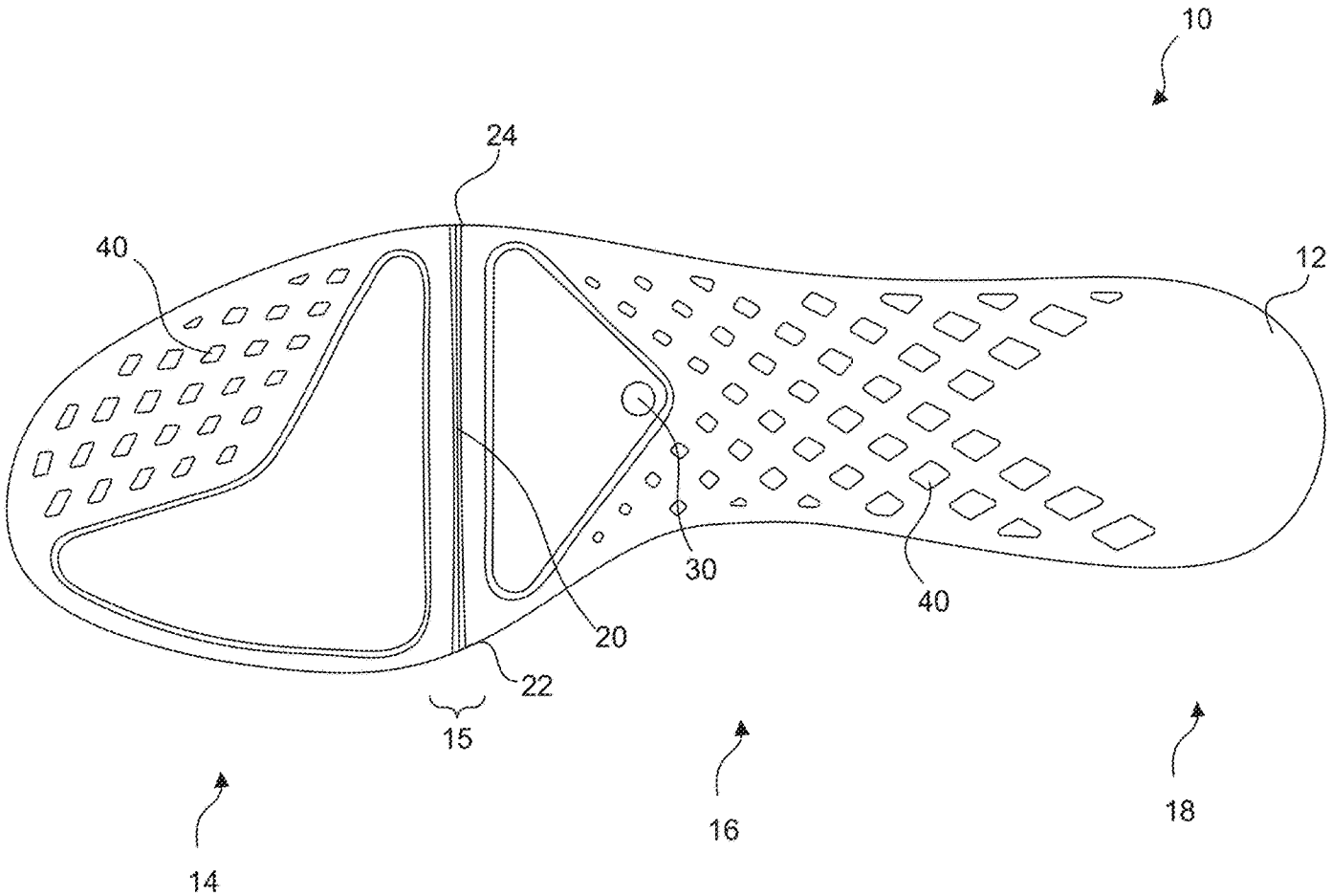
FIG. 2 shows a top view of a sole board according to some embodiments.
Figure 3:
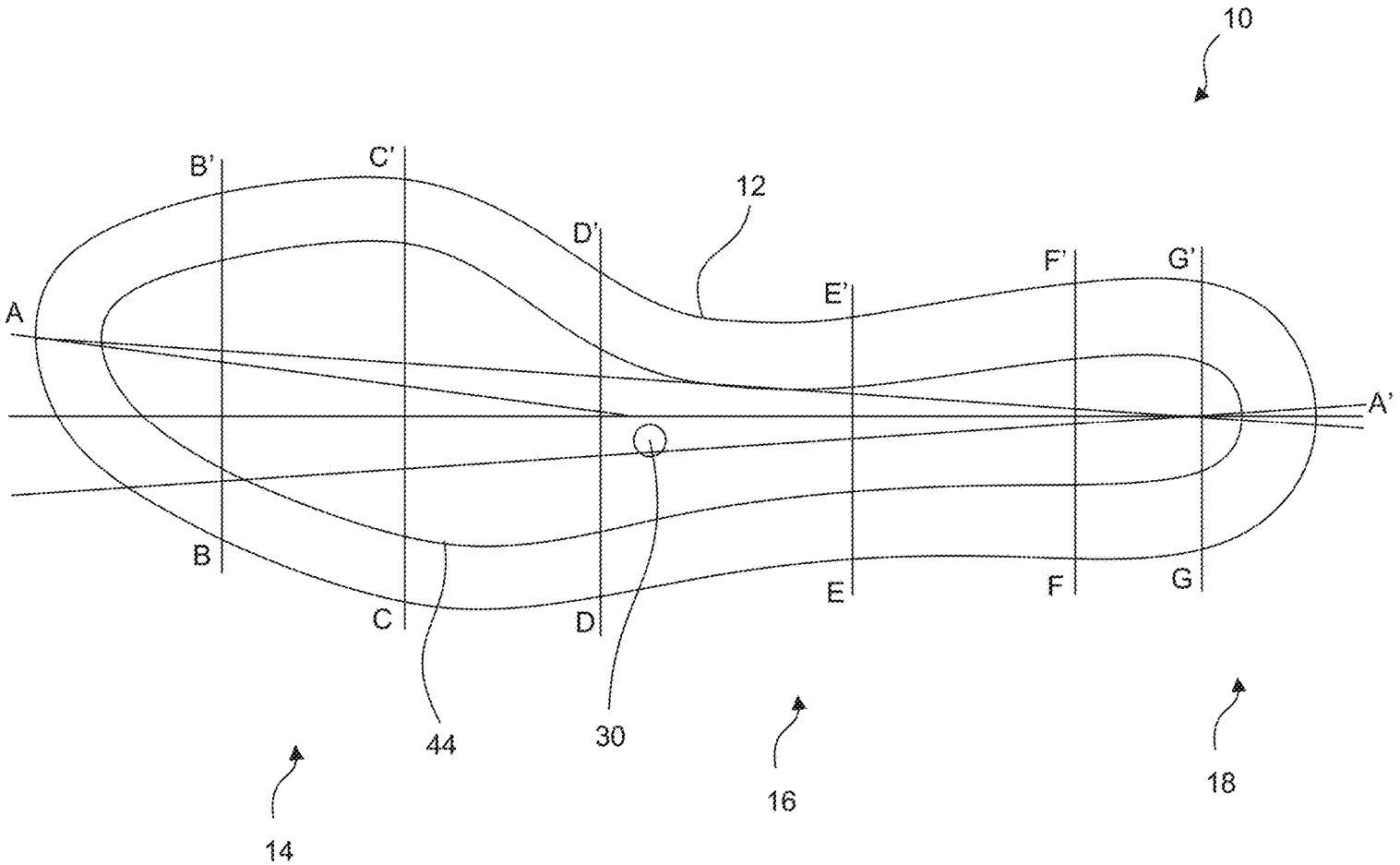
FIG. 3 shows a bottom view of a sole board according to some embodiments.
Figure 4:
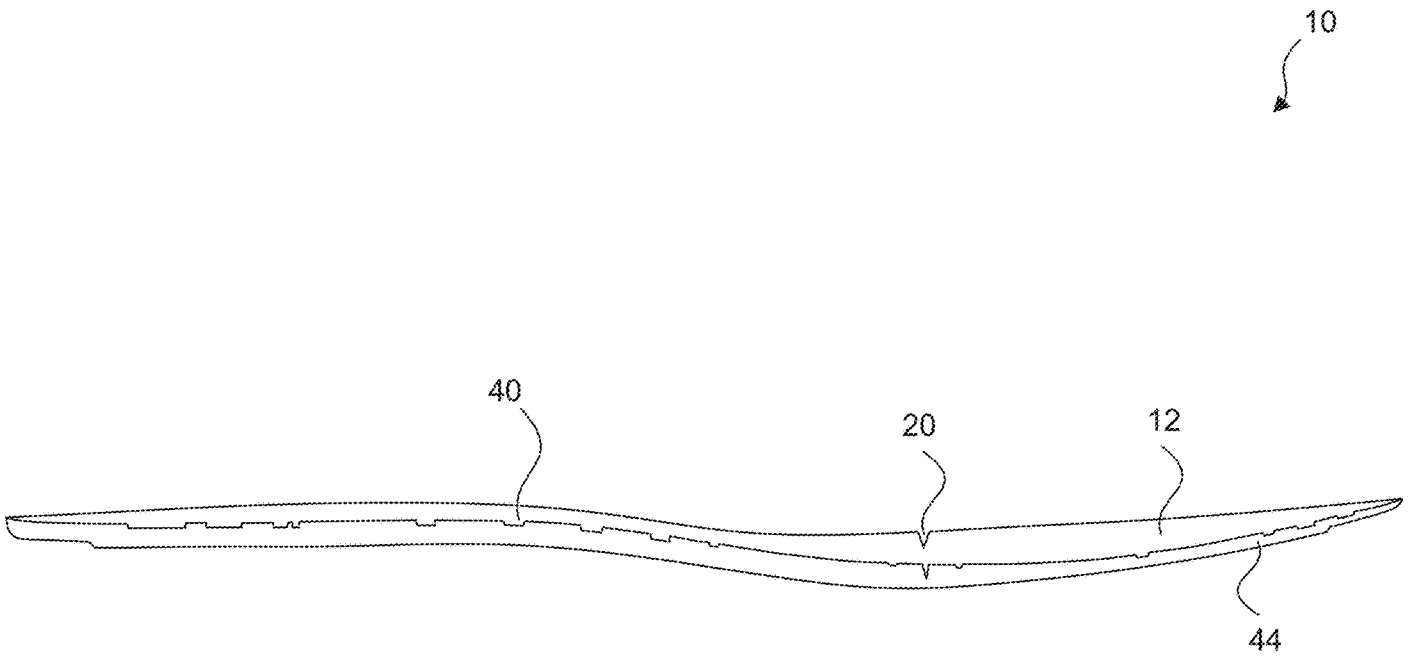
FIG. 4 shows a medial side view of a sole board according to some embodiments.
Figure 5:
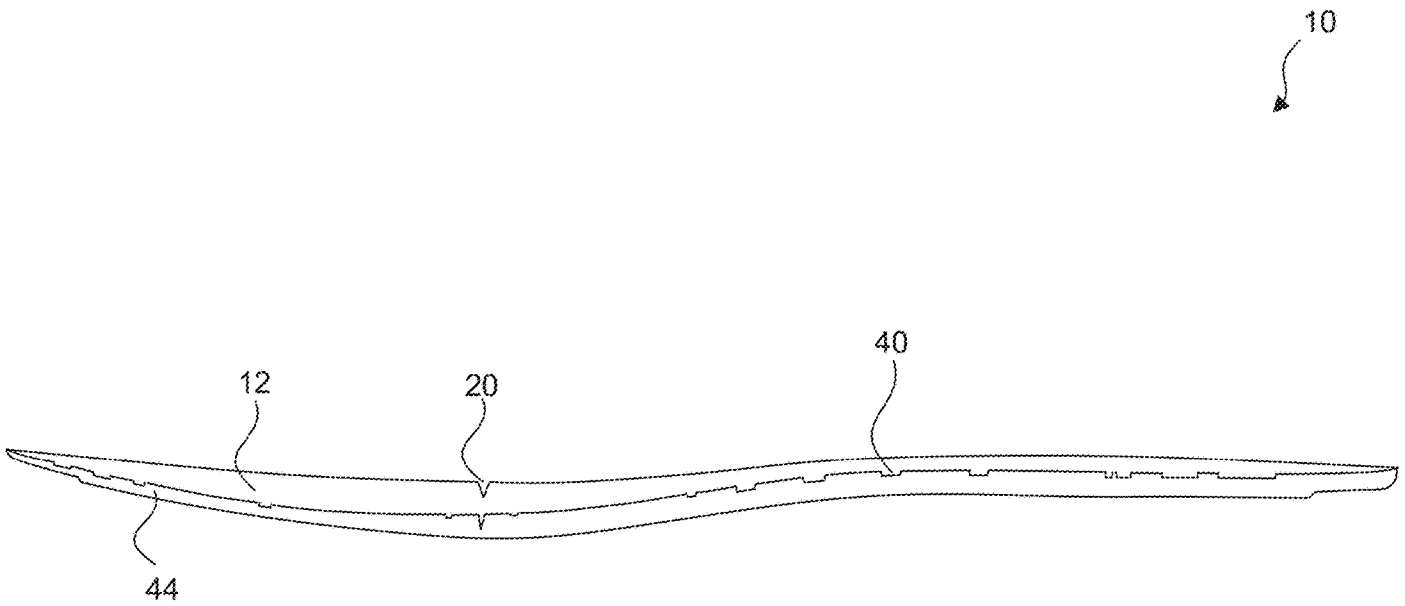
FIG. 5 shows a lateral side view of a sole board according to some embodiments.
Figure 6:
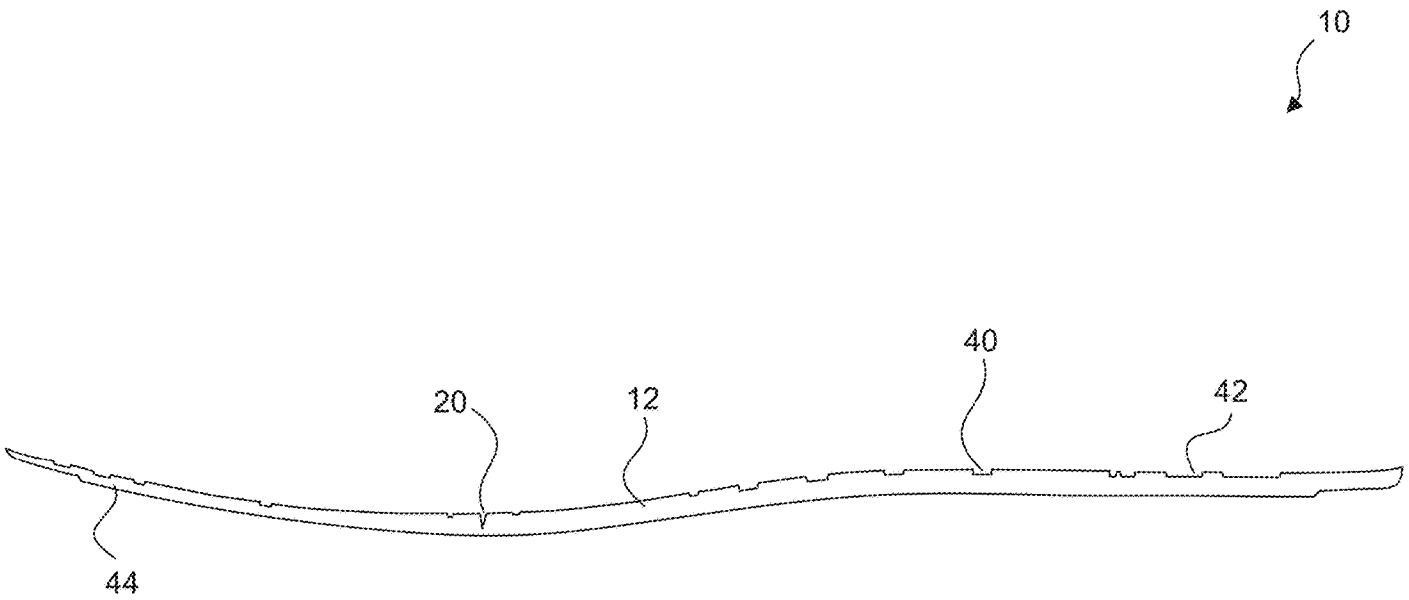
FIG. 6 shows a cross-section view of the sole board of FIG. 3 along line A-A' according to some embodiments.
Figure 7:
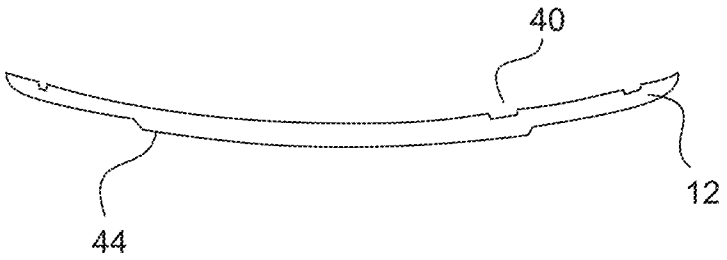
FIG. 7 shows a cross-section view of the sole board of FIG. 3 along line B-B' according to some embodiments.
Figure 8:
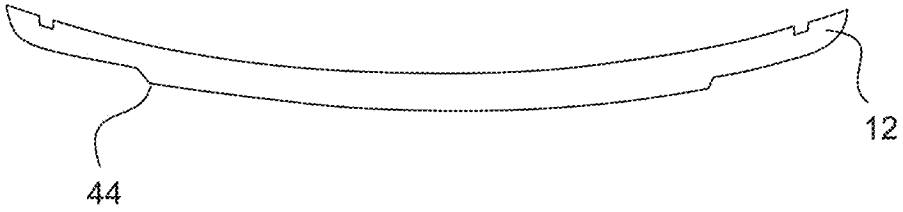
FIG. 8 shows a cross-section view of the sole board of FIG. 3 along line C-C' according to some embodiments.
Figure 9:
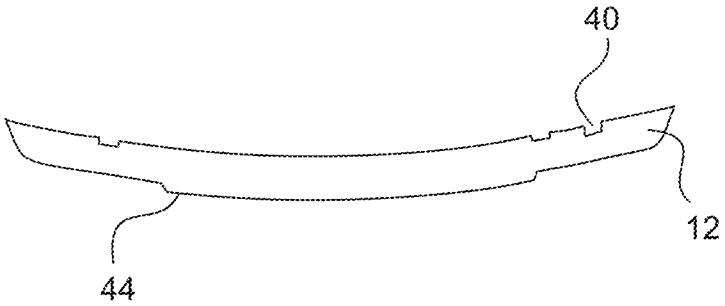
FIG. 9 shows a cross-section view of the sole board of FIG. 3 along line D-D' according to some embodiments.
Figure 10:
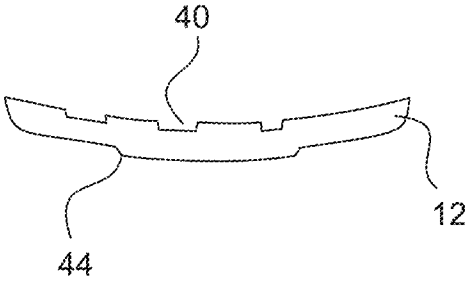
FIG. 10 shows a cross-section view of the sole board of FIG. 3 along line E-E' according to some embodiments.
Figure 11:
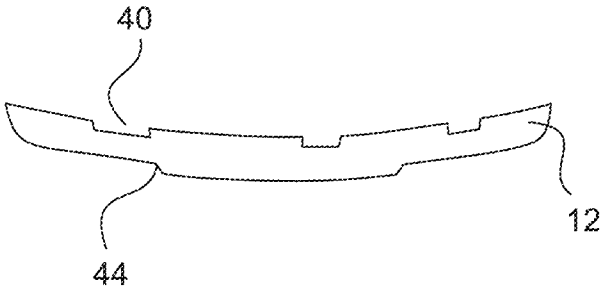
FIG. 11 shows a cross-section view of the sole board of FIG. 3 along line F-F' according to some embodiments.
Figure 12:
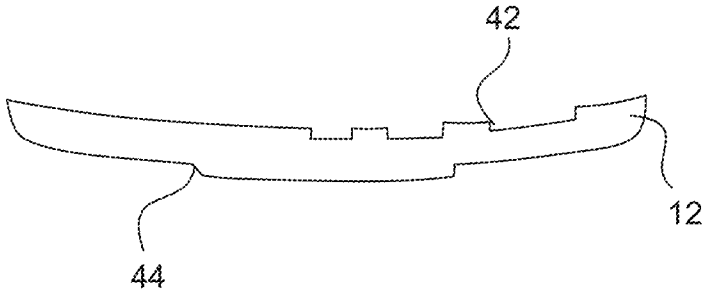
FIG. 12 shows a cross-section view of the sole board of FIG. 3 along line G-G' according to some embodiments.

In some embodiments, sole board 10 comprises a lasting hole 30 through plate 12, as shown in FIGS. 1-3. In some embodiments, lasting hole 30 is disposed in midfoot region 14. In some embodiments, lasting hole 30 is disposed in the center of sole board 10. In some embodiments, lasting hole 30 has a radius between 3 and 4 millimeters. For example, lasting hole 30 may have a radius of 3.5 millimeters. In some embodiments, lasting hole 30 facilitates easier lasting of the article of footwear.

In some embodiments, sole board 10 comprises a plurality of indents 40 disposed on a top surface of plate 12. In some embodiments, plurality of indents 40 forms a honeycomb pattern, as shown, for example, in FIGS. 1 and 2. In some embodiments, plurality of indents 40 extends from forefoot region 14 to heel region 18. In some embodiments, plurality of indents 40 may include a logo 42. In some embodiments, logo 42 is disposed in heel region 18.

As noted above, channel 20 may allow for increased flexibility of sole board 10 during initial phases of bending, yet provide increased support during later phases of bending (i.e., after the sides of channel 20 begin to contact each other). In some embodiments, channel 20 extends from medial edge 22 to lateral edge 24. In some embodiments, channel 20 has a characteristic that may vary from medial edge 22 to lateral edge 24. In some embodiments, the characteristic is a depth of channel 20. In some embodiments, the depth of channel 20 may be different at medial edge 22 and lateral edge 24 than the depth of channel 20 at a middle of channel 20. For example, the channel 20 may be deeper at medial edge 22 and lateral edge 24 than at the middle of channel 20. In some embodiments, the depth of channel 20 may be less at medial edge 22 and lateral edge 24 than at the middle of channel 20.

Figure 13:
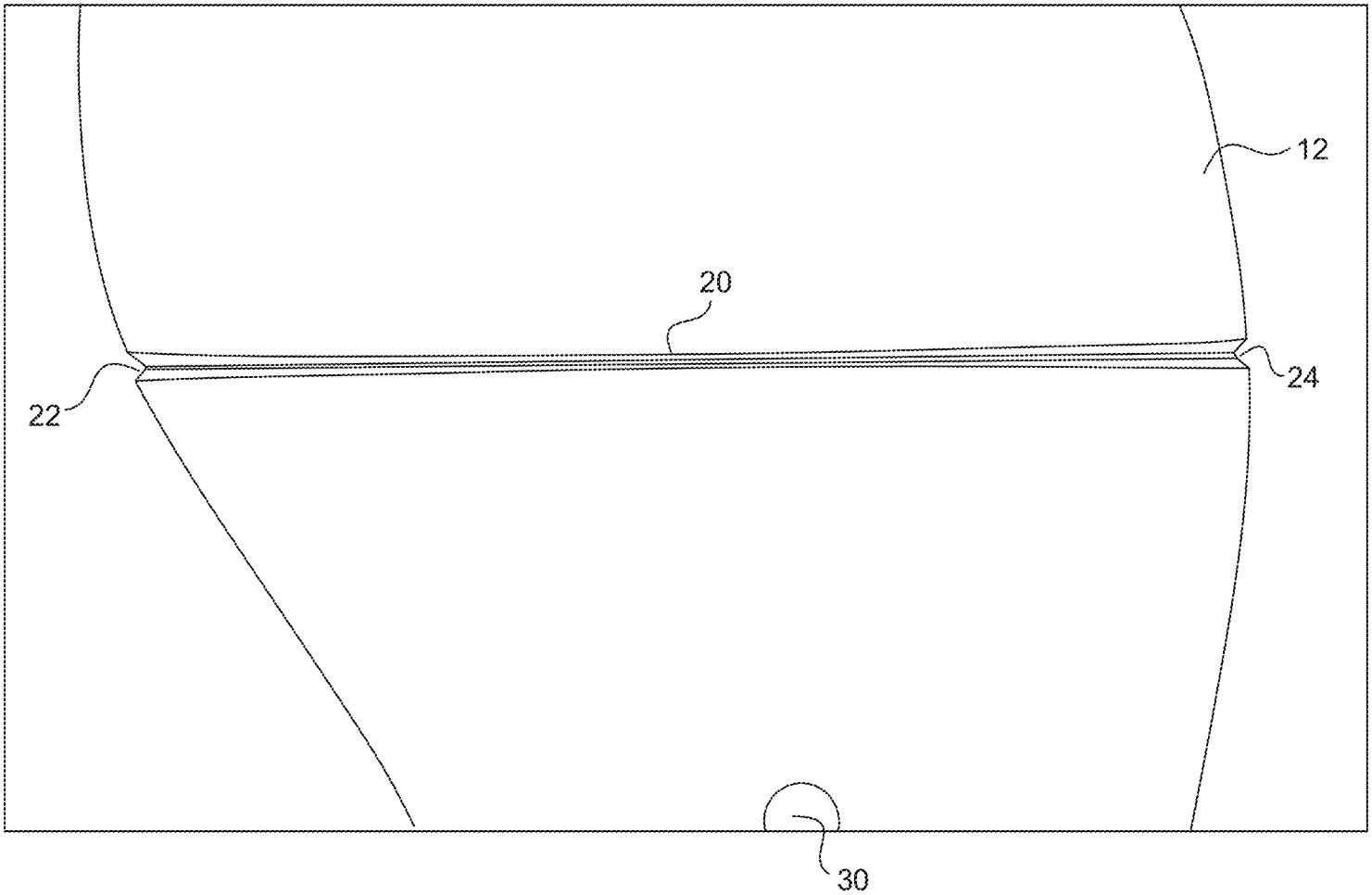
FIG. 13 shows a top view of a portion of a sole board according to some embodiments.

In some embodiments, the characteristic is a width of channel 20. In some embodiments, the width of channel 20 at medial edge 22 and lateral edge 24 is different than the width of channel 20 at the middle of channel 20. In some embodiments, the width of channel 20 is greater at medial edge 22 and lateral edge 24 than at the middle of channel 20, as shown, for example, in FIG. 13. In some embodiments, the width of channel 20 may be less at medial edge 22 and lateral edge 24 than at the middle of channel 20. In some embodiments, the middle of channel 20 is a portion of channel 20 that is intermediate medial edge 22 and lateral edge 24. In some embodiments, the middle of channel 20 is the lateral center point along channel 20 between medial edge 22 and lateral edge 24. In some embodiments, the middle of channel 20 is a portion of channel 20 surrounding and including the lateral center point. For example, in some embodiments, the width of channel 20 at medial edge 22 and lateral edge 24 is at least twice the width of channel 20 at the middle of channel 20. In some embodiments, the width of channel 20 at medial edge 22 is the same as the width of channel 20 at lateral edge 24. In some embodiments, the width of channel 20 is greater at one of the medial edge 22 and lateral edge 24 than the middle of channel 20 and/or the other of the medial edge 22 and lateral edge 24 to provide targeted increased support.

In some embodiments, the width of channel 20 at the middle of channel 20 is between 1 and 1.5 millimeters. For example, the width of channel 20 at the middle of channel 20 may be 1.2 millimeters. In some embodiments, the width of channel 20 at medial edge 22 and lateral edge 24 is between 2 and 3 millimeters. For example, the width of channel 20 at medial edge 22 and lateral edge may be 2.5 millimeters. In some embodiments, the width of channel 20 gradually increases from the middle of channel 20 to medial edge 22 and lateral edge 24.

Figure 14:
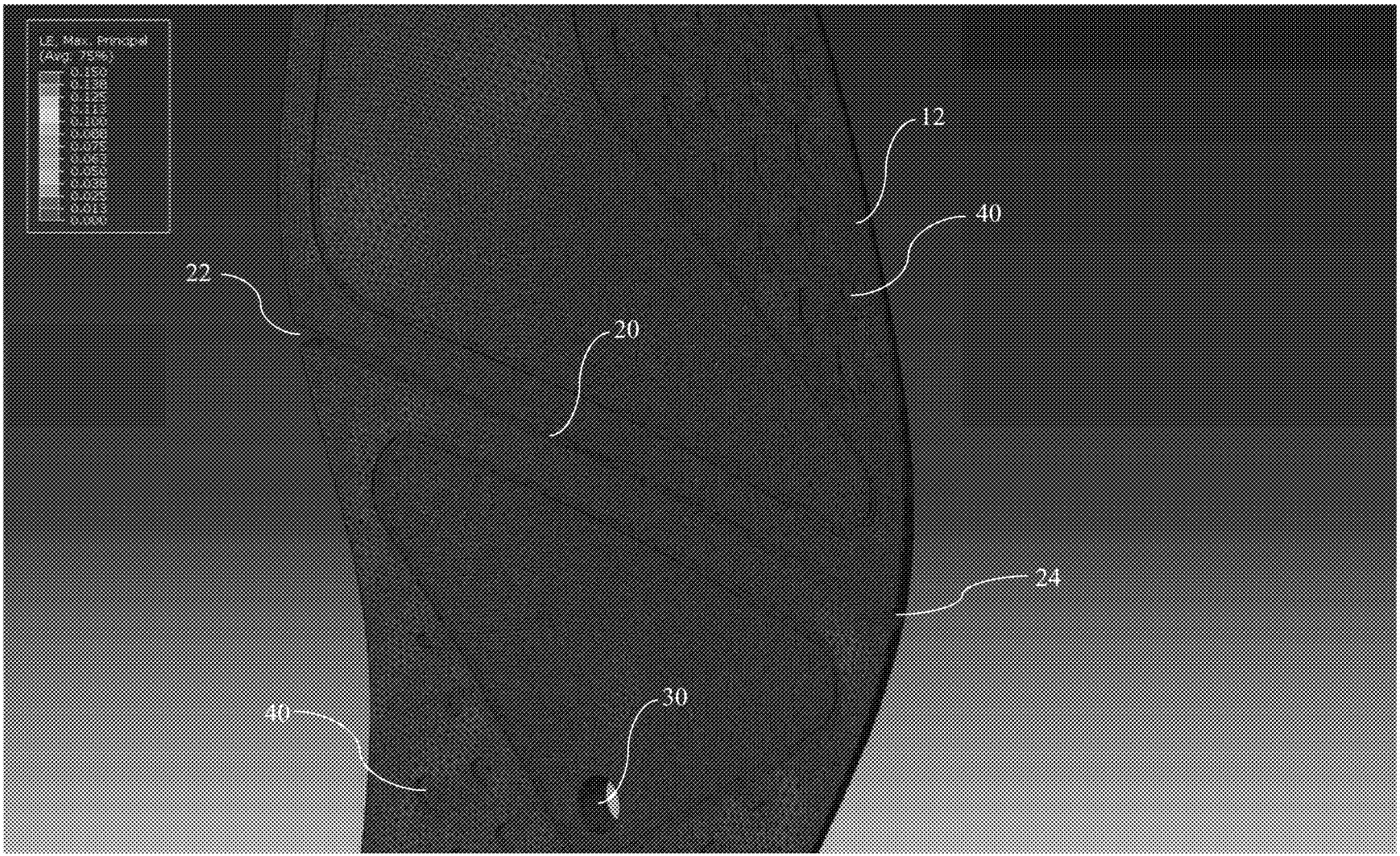
FIG. 14 shows a finite element analysis of a sole board in an unbent condition according to some embodiments.
Figure 15:
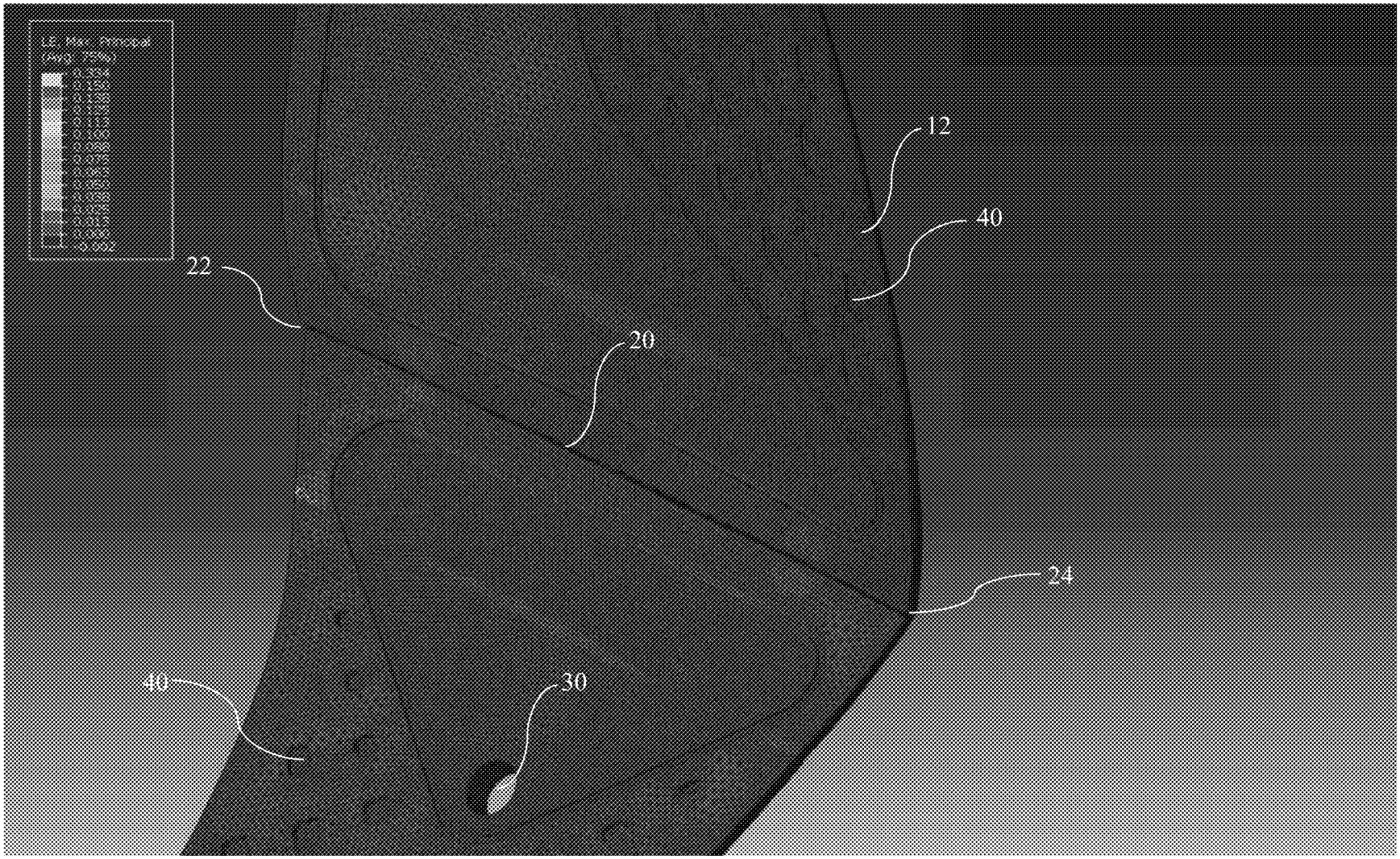
FIG. 15 shows a finite element analysis of a sole board in a partially bent condition according to some embodiments.
Figure 16:
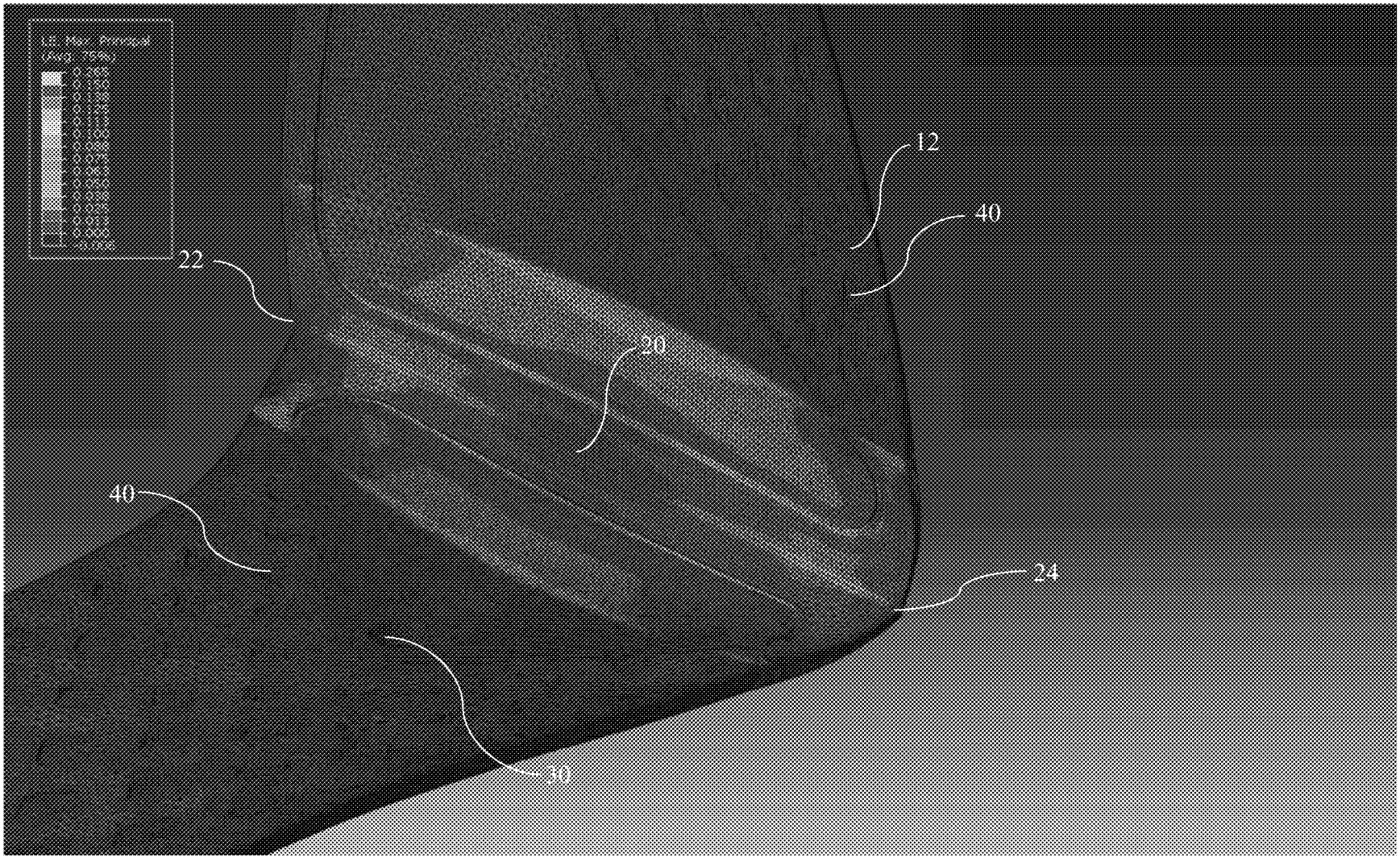
FIG. 16 shows a finite element analysis of a sole board in a bent condition according to some embodiments.

In some embodiments, by having a greater width at medial edge 22 and lateral edge 24 than in the middle of channel 20, the sides of channel 20 at medial edge 22 and lateral edge 24 do not contact each other until later in the bending cycle of sole board 10. This arrangement, as shown, for example, in FIGS. 14-16, allows for greater contact between the sides of channel 20 at the middle of channel 20 and helps distribute stress from the bending of sole board 10 across a greater area, which may result in increased stiffness as sole board 10 bends. Thus, sole board 10 and channel 20 allow for dynamic flexibility during walking and running that does not require a high amount of flexion, while also providing increased stiffness as sole board 10 bends to help prevent hyperextension of the wearer's toe.

Figure 17:
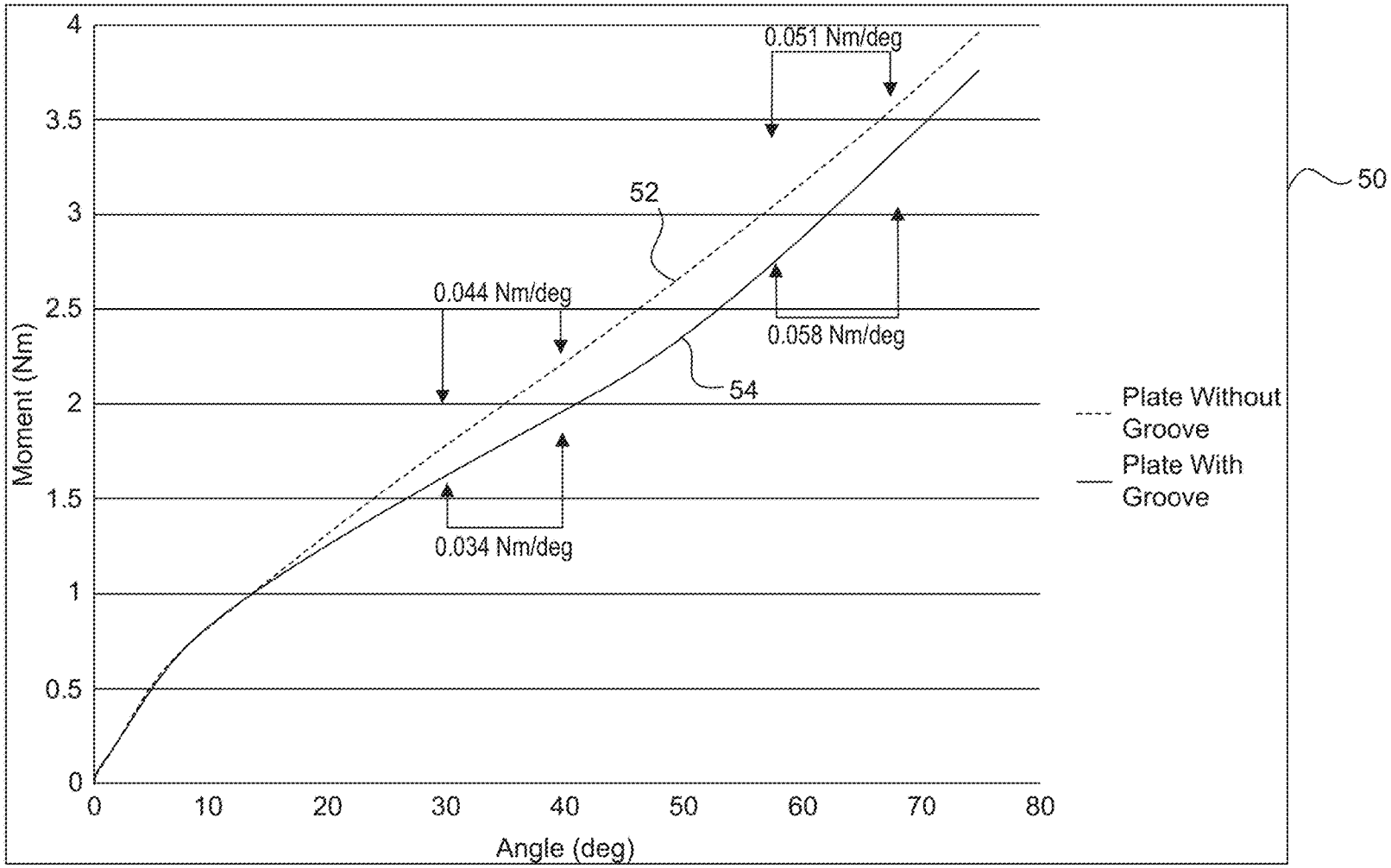
FIG. 17 shows a graph comparing moments relative to bend angles in a sole board with a channel according to some embodiments to a sole board without a channel.

FIG. 17 illustrates the benefit of having the width of channel 20 greater at medial edge 22 and lateral edge 24 than at the middle of channel 20 in graph 50. Graph 50 shows the moment required to bend sole board 10 to a particular angle. Graph 50 includes line 52, which shows the results for a sole board without a channel, and line 54, which shows the results for sole board 10 with channel 20. The slope of lines 52 and 54 show the rotational stiffness. As seen in graph 50, the rotational stiffness of sole board 10 with channel 20 is less than the sole board without a channel, thus making sole board 10 more flexible during movement that does not require high amounts of flexion. However, at larger angles (e.g., above 55 degrees), the rotational stiffness of sole board 10 with channel 20 is greater than the sole board without a channel, thus making sole board 10 less flexible and more stiff to protect the wearer's toes from hyperextension during movements that may require high amounts of flexion.

Figure 18:
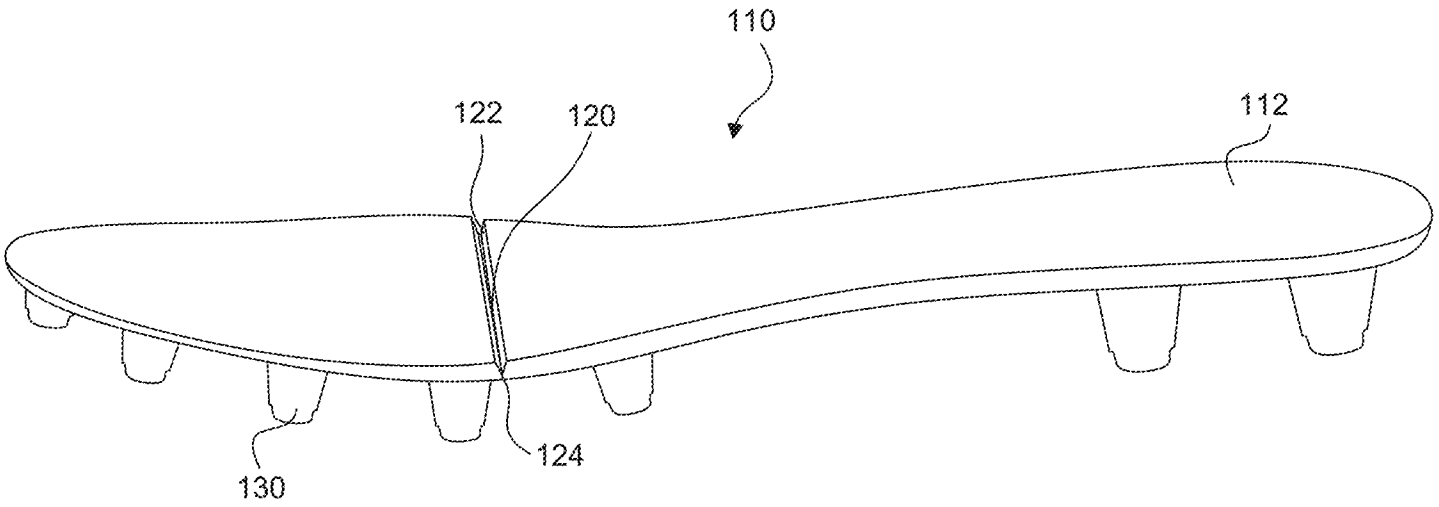
FIG. 18 shows a perspective view of a sole board according to some embodiments.

As noted above, in some embodiments, a sole board comprises a cleat frame structure. For example, a sole board 110, as shown in FIG. 18, may comprise a cleat frame structure. In some embodiments, sole board 110 comprises a plate 112 with a channel 120. In some embodiments, channel 120 is disposed in a similar location on plate 112 as channel 20 on plate 12. In some embodiments, channel 120 is shaped similarly to channel 20. For example, channel 120 may vary along its length such that a width of channel 120 at a middle of channel 120 is different than a width of channel 120 at medial edge 122 and lateral edge 124. In some embodiments, sole board 110 may be similar in design as sole board 10 and may include any of the features discussed above with respect to sole board 10. In some embodiments, sole board 110 comprises cleats 130 extending from a bottom of plate 112. In some embodiments, plate 112 comprises thermoplastic polyurethane. In some embodiments, plate 112 comprises a nylon-based composite or other composite.

Figure 19:
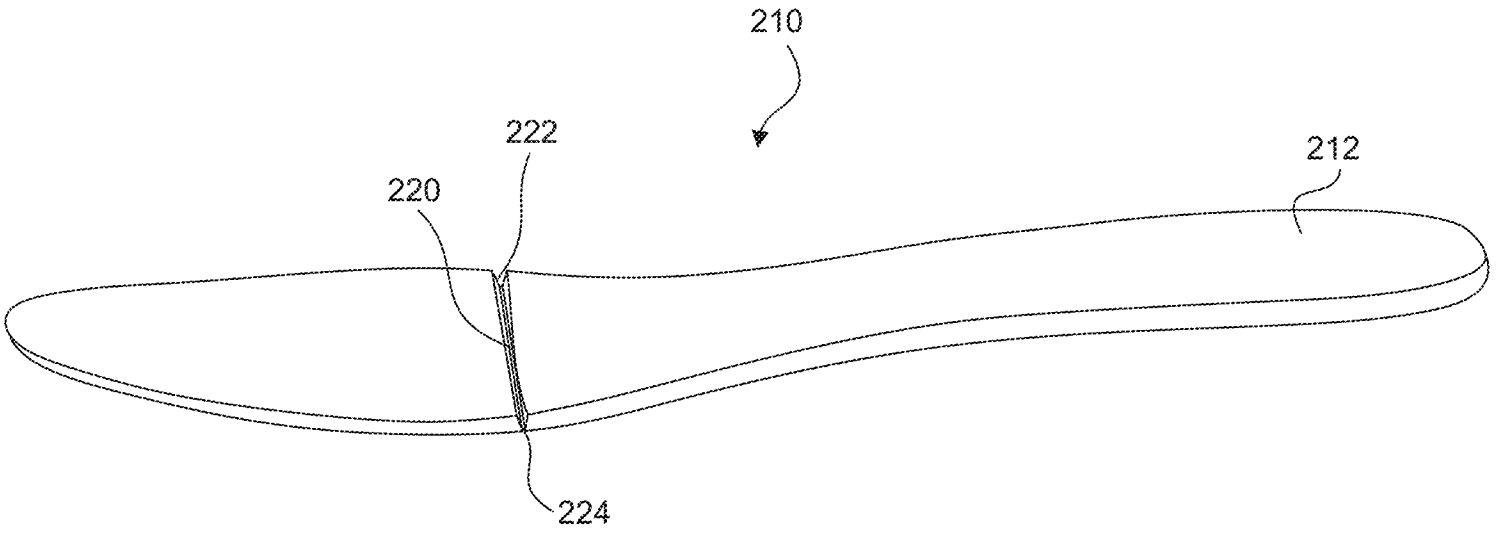
FIG. 19 shows a perspective view of a sole board according to some embodiments.

As noted above, in some embodiments, a sole board comprises a sock-liner. For example, a sole board 210, as shown in FIG. 19, may comprise a sock-liner. In some embodiments, sole board 210 comprises a sock-liner that is fixedly disposed in an upper of an article of footwear. In some embodiments, sole board 210 comprises a sock-liner that is detachably disposed in an upper of an article of footwear. In some embodiments, sole board 210 comprises a plate 212 with a channel 220. In some embodiments, channel 220 is disposed in a similar location on plate 212 as channel 20 on plate 12 and channel 120 on plate 112. In some embodiments, channel 220 is shaped similarly to channel 20 and channel 120. For example, channel 220 may vary along its length such that a width of channel 220 at a middle of channel 220 is different than a width of channel 220 at medial edge 222 and lateral edge 224. In some embodiments, sole board 210 may be similar in design as sole board 10 and may include any of the features discussed above with respect to sole board 10. In some embodiments, plate 212 comprises a foam. For example, plate 212 may be made of polyurethane foam, ethyl vinyl acetate, or other foam composites.

Figure 20:
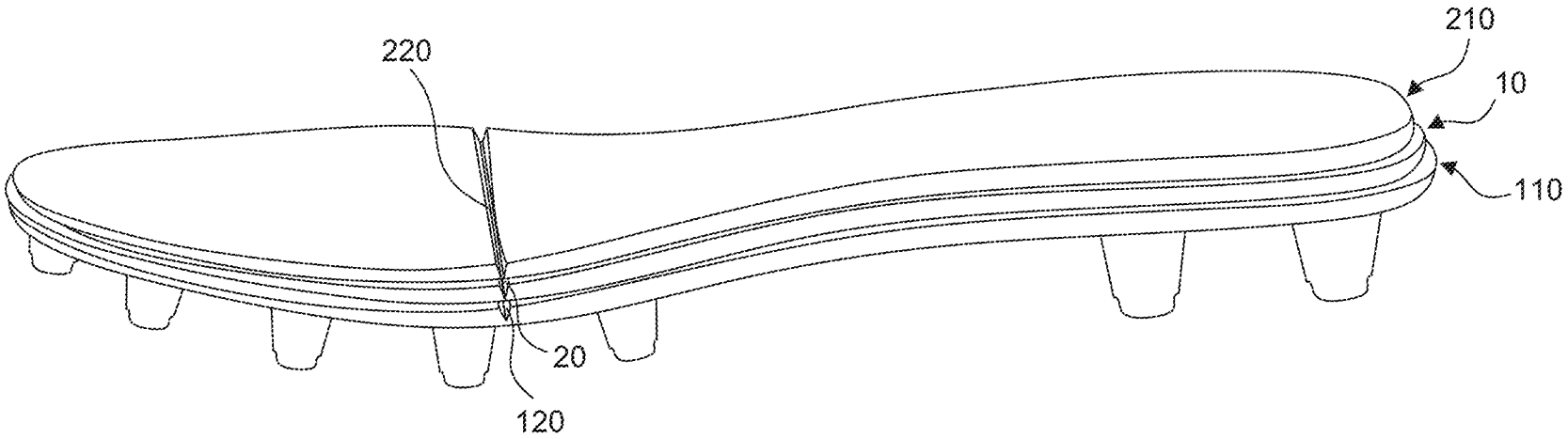
FIG. 20 shows a perspective view of a sole board according to some embodiments.

In some embodiments, an article of footwear comprises only one of sole board 10, sole board 110, and sole board 210 (e.g., only one of an insole, cleat frame structure, and sock-liner that has a channel or groove). In some embodiments, an article of footwear comprises any combination of sole board 10, sole board 110, and sole board 210. For example, as shown in FIG. 20, an article of footwear may comprise each of sole board 10, sole board 110, and sole board 210 (i.e., an insole, cleat frame structure, and sock-liner that each have a channel or groove). In some embodiments, channels 20, 120, and 220 may be aligned with each other such that channel 20 is underneath channel 120 and channel 220 is underneath channels 20 and 120.

Various embodiments described herein allow for appropriate amounts of flexibility and stiffness in an sole board at various angles of bending, thus facilitating flexion of the wearer's foot during specific movements of athletic activity (i.e., walking, running, etc.), but preventing hyperextension of the wearer's toes. Further variations of the embodiments described above may also be provided.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A sole board for an article of footwear, the sole board comprising:

a plate having a forefoot region, a midfoot region, a heel region, a top surface, and a bottom surface, wherein the top surface is configured to be disposed between a wearer's foot and the bottom surface when the article of footwear with the sole board is worn; and a channel disposed in the top surface of the plate in the forefoot region, the channel extending from a lateral edge of the plate to a medial edge of the plate, wherein a contour of the bottom surface at an area underneath the channel is smooth in a longitudinal direction across the channel, wherein a width of the channel at the lateral and medial edges of the plate is different than the width of the channel at a middle of the channel.

2. The sole board of claim 1, wherein the width of the channel at the lateral and medial edges of the plate is greater than the width of the channel at the middle of the channel.

3. The sole board of claim 1, wherein the width of the channel at the lateral and medial edges of the plate is at least twice the width of the channel at the middle of the channel.

4. The sole board of claim 1, wherein the width of the channel at the lateral edge of the plate is equal to the width of the channel at the medial edge of the plate.

5. The sole board of claim 1, wherein the width of the channel at the middle of the channel is between 1 and 1.5 millimeters.

6. The sole board of claim 1, wherein the width of the channel at the middle of the channel is 1.2 millimeters.

7. The sole board of claim 1, wherein the width of the channel at the medial and lateral edges of the plate is between 2 and 3 millimeters.

8. The sole board of claim 1, wherein the width of the channel at the medial and lateral edges of the plate is 2.5 millimeters.

9. The sole board of claim 1, wherein the width of the channel gradually increases from the middle of the channel to the medial edge of the plate.

10. The sole board of claim 1, wherein the width of the channel gradually increases from the middle of the channel to the lateral edge of the plate.

11. The sole board of claim 1, wherein the width of the channel at the lateral edge of the plate is greater than the width of the channel at the medial edge of the plate.

12. The sole board of claim 1, wherein the width of the channel at the medial edge of the plate is greater than the width of the channel at the lateral edge of the plate.

13. The sole board of claim 1, wherein the forefoot region comprises a metatarsal region, and wherein the channel is disposed in the metatarsal region.

14. The sole board of claim 1, wherein the channel has a V-shaped cross section.

15. The sole board of claim 1, wherein a thickness of the plate varies across the width of the channel.

16. The sole board of claim 1, wherein the channel is linear.

17. The sole board of claim 1, wherein the channel is the only channel extending from the lateral edge to the medial edge disposed in the top surface of the plate.

18. The sole board of claim 1, wherein sides of the channel are configured to contact each other when the sole board bends.

19. The sole board of claim 18, wherein, when the sole board bends, the sides of the channel at the middle of the channel are configured to contact each other before the sides of the channel at the medial and lateral edges of the plate contact each other.

20. A sole board for an article of footwear, the sole board comprising:

a plate having a medial edge, a lateral edge, a top surface, and a bottom surface, wherein the top surface is configured to be disposed between a wearer's foot and the bottom surface when the article of footwear with the sole board is worn; and a channel disposed in the top surface of the plate in a metatarsal region of the plate, the channel extending from the lateral edge to the medial edge, wherein a bottom of the channel is disposed above the bottom surface of the plate, wherein a contour of the bottom surface at an area underneath the channel is smooth in a longitudinal direction across the channel, wherein a width of the channel at the lateral edge and the medial edge is different than the width of the channel at a middle of the channel.

* * * * *